US006926936B2

(12) United States Patent
Barcock et al.

(10) Patent No.: US 6,926,936 B2
(45) Date of Patent: Aug. 9, 2005

(54) INK-JET RECORDING SHEET WITH IMPROVED OZONE RESISTANCE

(75) Inventors: Richard A. Barcock, Aylesbury (GB); Douglas J. Brownbridge, High Wycombe (GB); Natasha M. Dimbleby, High Wycombe (GB); Aidan Joseph Lavery, Aylesbury (GB); Robert M. Phillips, Great Missenden (GB)

(73) Assignee: Felix Schoeller Jr. Foto-und Spezialpapiere GmbH & Co. KG, Osnabrück (DE)

( * ) Notice: Subject to any disclaimer, the term of this patent is extended or adjusted under 35 U.S.C. 154(b) by 235 days.

(21) Appl. No.: 10/442,024

(22) Filed: May 20, 2003

(65) Prior Publication Data

US 2003/0219611 A1 Nov. 27, 2003

(30) Foreign Application Priority Data

May 22, 2002 (DE) ..... 102 22 454

(51) Int. Cl.[7] ..... B41M 5/40
(52) U.S. Cl. ..... 428/32.24; 428/32.3; 428/32.31
(58) Field of Search ..... 428/32.24, 32.3, 428/32.31

(56) References Cited

U.S. PATENT DOCUMENTS 4,474,847 A * 10/1984 Schroder et al. ..... 428/32.35
5,032,226 A * 7/1991 Winiker ..... 162/158
5,302,437 A * 4/1994 Idei et al. ..... 428/32.22
5,670,249 A * 9/1997 Tanuma ..... 428/32.1
6,344,262 B1 * 2/2002 Suzuki ..... 428/32.1
6,502,935 B1 * 1/2003 Barcock et al. ..... 347/105
6,524,696 B1 * 2/2003 Gumbiowski et al. ..... 428/327
6,677,006 B2 * 1/2004 Otani et al. ..... 428/32.25
2002/0008753 A1 * 1/2002 Suzuki et al. ..... 347/106
2002/0025412 A1 * 2/2002 Hanmura et al. ..... 428/195
2003/0039808 A1 * 2/2003 Ichinose et al. ..... 428/195
2004/0209012 A1 * 10/2004 Barcock et al. ..... 428/32.24

FOREIGN PATENT DOCUMENTS

| | | | |
|---|---|---|---|
| DE | 100 20 346 | C2 | 11/2000 |
| EP | 0 524 635 | A1 | 1/1993 |
| EP | 1 016 542 | A1 | 7/2000 |
| EP | 1 138 509 | A2 | 10/2001 |
| EP | 1 157 847 | A1 | 11/2001 |
| EP | 1 174 279 | A1 | 1/2002 |
| JP | 08164664 | A | 6/1996 |
| JP | 10264501 | A | 10/1998 |

* cited by examiner

*Primary Examiner*—B. Shewareged
(74) *Attorney, Agent, or Firm*—Amster, Rothstein & Ebenstein LLP

(57) ABSTRACT

An ink-jet recording material having a high ozone resistance comprises at least one ink-absorbing and at least one dye-fixing layer wherein on the top and/or bottom side of the dye-fixing layer, at least one water-soluble compound exhibiting ionic charge centres is arranged, which compound exhibits a dissociation constant in the region of $1\times10^{-3}$ to $1\times10^{-14}$ with a conductivity range $\lambda$ of 6 to 25 ms at a temperature of 25° C.±1° C. in a 0.1 molar aqueous solution.

11 Claims, 2 Drawing Sheets

EMBODIMENT I

EMBODIMENT II

INK-JET RECORDING SHEET WITH IMPROVED OZONE RESISTANCE

This application claims the benefit of German Patent Application No. 102 22 454.4, filed May 22, 2002, the content of which is hereby incorporated by reference in its entirety.

TECHNICAL FIELD OF THE INVENTION

The present invention concerns a recording material for the ink-jet recording process with a carrier, at least one ink-absorbing layer and at least one dye-fixing layer.

BACKGROUND OF THE INVENTION

In the case of the ink-jet printing process, tiny ink droplets are applied by means of different techniques, which have already been repeatedly described, onto a recording material and absorbed by the latter. The recording material is subject to different requirements such as a high colour density of the printed dots, a high ink absorption capacity, a short drying time and a sufficient smudge resistance associated therewith, a dye diffusion in the transverse direction of the printed dots not exceeding the required extend (bleed) as well as a low color coalescence and a high resistance to water. Other requirements, in particular for photograph-type prints, are an even print gloss and surface gloss of the recording material.

As a result of the great progress achieved in the ink-jet technology field regarding the quality of the image and the speed of printing of the printer, the ink-jet color printer market has grown enormously. It is expected that, in the next few years, the area of digital photography, in particular of ink-jet materials of photographic quality, will continue to develop strongly. Due to the need to achieve a photographic image quality in the case of ink-jet printed products, achieving a high image durability is one of the most important development tasks. This leads to new developments both regarding the image-receiving materials and the dye-based inks.

Ink-jet recording materials can be divided into two classes: materials with recording layers swelling in water which contain binders such as gelatine or polyvinyl alcohol, and materials with microporous layers.

Materials with layers swelling in water have the advantage that they are glossy and exhibit high color densities after printing. They exhibit a satisfactory stability vis-à-vis ozone since the swellable layers—like a barrier—prevent ozone from penetrating into the material. However, the material has disadvantages regarding the image quality (bleed, color coalescence) and the drying time.

The microporous systems, which are capable of rapidly absorbing the ink during printing as a result of cavities in the applied layer, exhibit an excellent image quality as a result of the good color fixing effect. They have a short drying time and problems regarding coalescence and bleed do not occur. The images produced by means of such microporous recording materials are not resistant to light and react in a sensitive manner to the gases contained in the air, particularly ozone. The gas can easily penetrate into the micropores of the recording layers and—encouraged by the catalytic effect of the pigments contained in the layers—possibly attack the double bonds of the dyes. The reactivity vis-à-vis ozone can be further increased by moisture at elevated temperatures. Cyan blue dye has a particularly sensitive reaction to ozone.

The solutions to the problem suggested at present include laminating of the printed image with a polyester film or the use of inks containing alkali metal additives and ammonium or amine salt groups. Although these solutions have positive aspects, they are not free from disadvantages. The disadvantages include, on the one hand, an increase in the production costs caused by the laminating step; on the other hand, the metal-containing compounds tend to cause significant tint shifts which become noticeable as color turbidity.

According to JP 10-264501, the stability vis-à-vis ozone can be improved by using a plasticiser-containing thermoplastic resin as binder in the ink absorption layer. The anti-ozone-protecting effect is presumably achieved by the pigment and the absorbed ink dyes being enveloped by the resin.

A further possibility of improving the stability vis-à-vis ozone is described in JP 08-164664 where an inorganic pigment, the surface of which is modified with cycloamylose, is used in the ink absorption layer.

In EP 0 524 635 A1, a recording material is suggested which contains a combination of starch particles, an ethylene-vinyl acetate copolymer and a cationic dye-fixing agent in the ink absorption layer.

According to U.S. Pat. No. 6,344,262 B1 an Mg thiocyanate is used in a porous layer containing aluminium oxide in order to improve the stability vis-à-vis light and ozone. The porous layer is the ink-recepting layer.

In EP 1 157 847 A1, the use of benzotriazol derivatives in the ink absorption layer for improving the resistance of the recording material to gas is described.

SUMMARY OF THE INVENTION

The object underlying the present invention is to provide a further recording material for the ink-jet printing process, which exhibits an improved resistance to the effect of ozone.

This object is achieved by way of an ink-jet recording material with a carrier and at least one ink-absorbing layer, at least one dye-fixing layer, at least one water-soluble compound exhibiting ionic charge centres being arranged on the top and/or the bottom surface of the dye-fixing layer, which compound exhibits a dissociation constant in the region of $1\times10^{-3}$ to $1\times10^{-14}$ with a conductivity range $\lambda$ of 6 to 25 ms at a temperature of 25° C.±1° C. in a 0.1 molar aqueous solution.

The invention is based on the finding that the stability of the ink dyes vis-à-vis ozone in microporous recording materials is increased in the presence of compounds exhibiting ionic centres. The absorption of ink is not negatively affected by the arrangement of the compounds.

DETAILED DESCRIPTION OF THE INVENTION

Figure 1:
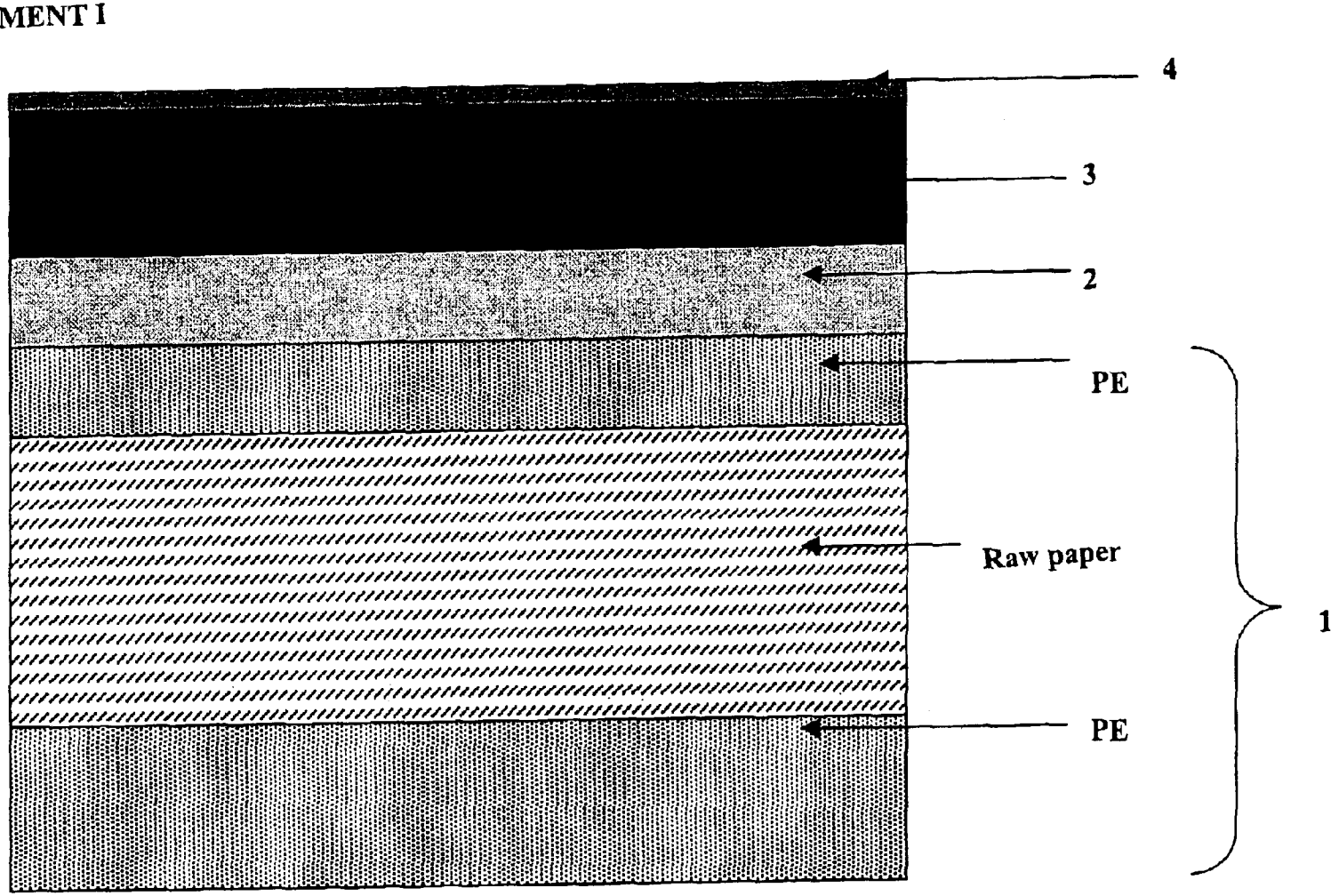
FIG. 1. Preferred embodiment I of the invention. The recording material contains a sheet of paper (1) coated on both sides with polyolefin, at least one ink-absorbing layer (2) arranged thereon containing finely divided pigment and a binder, at least one dye-fixing layer (3) containing a finely divided pigment and a binder and at least one layer (4), arranged on the dye-fixing layer (3), containing a layer containing a water-soluble compound with ionic charge centres.

According to a particularly preferred embodiment, the compounds exhibiting ionic centres are arranged on the top and/or bottom side of the dye-fixing layer in the form of one layer. This layer is free from pigments.

Compounds exhibiting ionic charge centres should be understood to mean compounds charged according to the invention. Water-soluble compounds exhibiting ionic charge centres, which are suitable according to the invention, are, for example, those containing functional groups such as $RCO_2^-$, $RO^-$, $RS^-$, $SCN^-$, $S_2O_3^-$ and/or $RSO_3^-$, R being a substituted or unsubstituted alkyl with 1 to 8, in particular 1 to 4 carbon atoms, or a substituted or unsubstituted, aromatic or non-aromatic ring system with 5 to 10 carbon atoms. Alkali metals of group I and an ammonium ion have proved to be particularly suitable as counter ions.

According to a preferred embodiment of the invention, the compound additionally contains an ethylene-unsaturated bond.

Compounds with a water-solubility of more than about 10% by weight at 25° C. have proved to be particularly suitable.

The arrangement of these compounds can be present in the form of a layer which also contains binders, wetting agents, surfactants, defoaming agents and light stabilizing agents. Suitable binders are, for example, water-soluble and/or water-dispersible polymers with a glass transition temperature $T_g$ of 30 to 85° C., measured according to the so-called 'dynamic scanning colorimetry' method (DSC); these polymers have a viscosity of maximum 60 cPs, measured in a 4% aqueous solution. They include in particular polyurethanes, polyacrylates, polyvinyl alcohols, gelatine, gelatine derivatives, cellulose, starches, modified starches and/or polyvinyl acetates. A layer containing a polyurethane and/or a polyacrylate, apart from the compound according to the invention, as binder is particularly preferred. The quantitative ratio of polymer to water-soluble compound is preferably 1:1 to 1:10. The application weight of the pigment-free layer can be 0.05 to 5 g/m$^2$, in particular 0.1 to 2 g/m$^2$.

The arrangement of these compounds in a binder-containing layer has proved advantageous because the resistance to ozone and the gloss are further enhanced without negatively affecting the ink absorption.

According to a preferred embodiment I of the invention (FIG. 1), the recording material contains a sheet of paper (1) coated on both sides with polyolefin, at least one ink-absorbing layer (2) arranged thereon containing finely divided pigment and a binder, at least one dye-fixing layer (3) containing a finely divided pigment and a binder and at least one layer (4), arranged on the dye-fixing layer (3), containing a layer containing a water-soluble compound with ionic charge centres.

Figure 2:
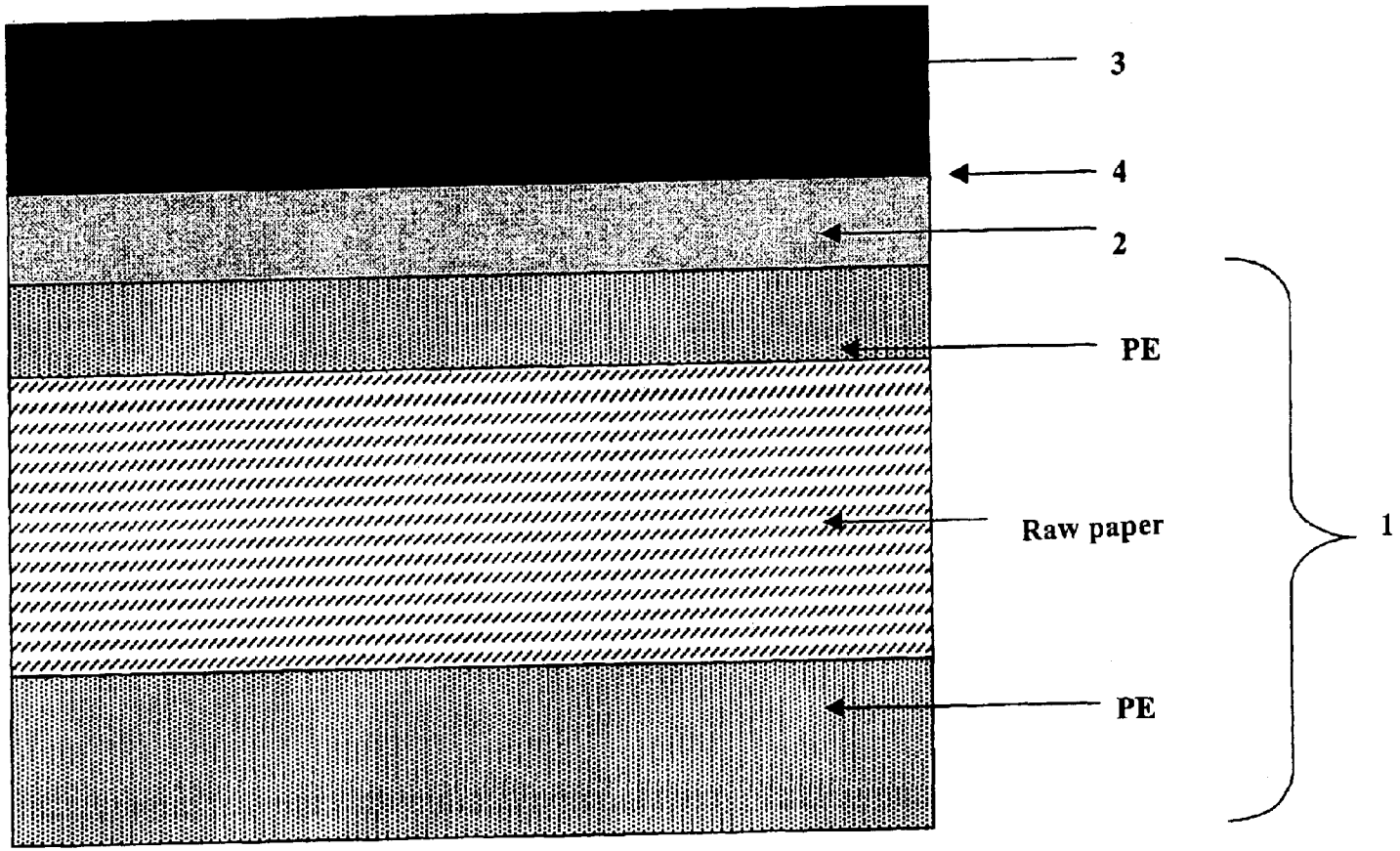
FIG. 2. Preferred embodiment II of the invention. The recording material contains a paper (1) coated on both sides with polyolefin, at least one ink-absorbing layer (2) arranged thereon containing a finely divided pigment and a binder, at least one layer (4) containing a water-soluble compound with ionic charge centres and at least one dye-fixing layer (3), arranged on the layer (4), containing a finely divided pigment and a binder.

According to a further preferred embodiment II of the invention (FIG. 2), the recording material contains a paper (1) coated on both sides with polyolefin, at least one ink-absorbing layer (2) arranged thereon containing a finely divided pigment and a binder, at least one layer (4) containing a water-soluble compound with ionic charge centres and at least one dye-fixing layer (3), arranged on the layer (4), containing a finely divided pigment and a binder.

The grain size distribution of the pigment of the ink-absorbing layer (2) is preferably in the region of 150 to 1,000 nm with an average particle size of 240 to 350 nm.

Pigments, suitable according to the invention, of the ink-absorbing bottom layer (2) are, for example, aluminium oxide, aluminium hydroxide, aluminium oxide hydrate, silicic acid, barium sulphate and titanium dioxide. In the bottom layer, a pigment based on amorphous silica is particularly preferred. Such a pigment can be cationically modified.

The pigment used in the dye-fixing layer has an average particle size of 10 to 500 nm, in particular 50 to 100 nm.

Pigments of the dye-fixing layer which are suitable according to the invention are, for example, aluminium oxide, aluminium hydroxide, aluminium oxide hydrate, silicic acid, barium sulphate and titanium dioxide.

The ink-absorbing and the dye-fixing layer contain a water-soluble and/or water-dispersible polymeric binder. Suitable binders are, for example, polyvinyl alcohol, completely or partly saponified, cationically modified polyvinyl alcohol, polyvinyl alcohol exhibiting silyl groups, polyvinyl alcohol exhibiting acetal groups, gelatine, polyvinyl pyrrolidone, starch, carboxymethylcellulose, polyethylene glycol, styrene-butadiene latex and styrene-acrylate latex. The quantity of binder in the dye-fixing and the ink-absorbing layer is 5 to 35% by weight, preferably 10 to 30% by weight respectively, based on the weight of the dry layer.

Both layers may contain usual additives and auxiliary agents such as surfactants, wetting agents and dye-fixing agents such as polyammonium compounds.

The application thicknesses of the ink-absorbing and the dye-fixing layer can be 10 to 60 $\mu$m, preferably 20 to 50 $\mu$m.

In principle, any raw paper can be used as carrier material. Surface-sized, calendered or non-calendered or highly sized raw paper is preferred. The paper can be acid-sized or neutrally sized. The raw paper should have a high dimensional stability and be capable of absorbing the liquid contained in the ink without forming undulations. Paper with a high dimensional stability made of cellulose mixtures of soft wood cellulose and eucalyptus cellulose is particularly suitable. In this respect, reference is made to the disclosure of DE 196 02 793 B1 which describes a raw paper for an ink-jet recording material. The raw paper can contain further auxiliary agents and additives common in the paper industry such as dyes, optical brighteners or defoaming agents. Using waste cellulose and recovered waste paper is also possible.

Raw paper with a weight per surface area of 50 to 300 g/m$^2$ is used.

Paper coated on one or both sides with polyolefin, in particular with polyethylene (LDPE and/or HDPE) is particularly suitable as carrier material. The amount of polyethylene applied is 5 to 20 g/m$^2$.

Polymer sheets, for example of polyester or polyvinyl chloride are also suitable as carriers. The weight per surface area of the carrier can be 50 to 300 g/m$^2$.

Any desired, generally known method of application and metering can be used to apply the layers, e.g. roller application, gravure or nipp methods as well as air brush or roller blade metering. The application by means of a cascade coating facility or a slot die is particularly preferred.

To adjust the curl behaviour, antistatics and the feeding in the printer, the reverse side can be provided with a separate operating layer. Suitable reverse layers are described in DE 43 08 274 A1 and DE 44 28 941 A1, reference to the disclosure of which is made herewith.

The following examples serve as further illustration of the invention.

EXAMPLES 1 TO 10

For the following tests, a paper, neutrally sized with alkyl ketene dimer and coated on both sides with polyethylene, with a weight per surface area of 173 g/m$^2$ was used as carrier. The front side of the raw paper was extrusion-coated with a low density polyethylene (LDPE) coating mass containing 10% by wt. of $TiO_2$ and the reverse side was extrusion-coated with a clear LDPE. The coating on the front side amounted to 19 g/m$^2$, the application on the reverse side amounted to 22 g/m$^2$.

The front side of the carrier was coated, using a feed hopper, with a coating mass containing 75% by wt. of a finely divided silicic acid (300 nm) and 25% by wt. of a polyvinyl alcohol (degree of saponification 88 mole %). Onto the layer absorbing the solvent of the ink, whose application weight was 12 g/m$^2$, a dye-fixing layer containing 89% by wt. of a finely divided aluminium oxide (100 nm) and 11% by wt. of a polyvinyl alcohol (degree of saponification 88 mole %) was applied with a feed hopper. The application weight was 30 g/m$^2$.

The following aqueous solutions were applied onto the dye-fixing layer. The compounds used therein have the properties listed in Table 1. The application quantities of the substances used, in the dry state, are given in Table 2.

TABLE 1

Compounds used according to the invention

| Compound | MWt | Kb | pKb | λ (ms) | ° C. |
|---|---|---|---|---|---|
| N-Vinyl acetamide | 85 | $2.29 \times 10^{-15}$ | (14.6) | 0.0 | 25.1 |
| Na acrylate | 94 | $1.66 \times 10^{-12}$ | 11.8 | 6.08 | 23.9 |
| Na vinyl sulphonate | 130 | $1.26 \times 10^{-13}$ | 12.9 | 8.81 | 23.9 |
| Disodium fumarate | 160 | $1.8 \times 10^{-13}$ | 12.7 | 12.68 | 23.9 |
| Na acetate | 82 | $1.05 \times 10^{-12}$ | 12.0 | 6.42 | 23.5 |
| Na citrate dihydrate | 294 | $3.80 \times 10^{-11}$ | 10.4 | 8.29 | 23.9 |
| 4-Hydroxybenzoic acid Na salt | 160 | $8.32 \times 10^{-13}$ | 12.1 | 5.75 | 25.5 |
| Li thiocyanate hydrate | 65 | $1.58 \times 10^{-11}$ | 10.8 | 5.67 | 26.0 |
| Trisodium trithiocyanurate nonahydrate | 405 | $1 \times 10^{-3}$ | 3 | >20 | 23.7 |
| Trisodium ethylene-diaminetetraacetate hydrate | 358 | $2.51 \times 10^{-12}$ | 11.6 | 13.77 | 24.4 |
| Na thiosulphate pentahydrate | 248 | $1.05 \times 10^{-17}$ | (17) | 15.63 | 26.5 |
| Diammnonium ethylene-diaminetetraacetate hydrate | 326 | $1.15 \times 10^{-18}$ | (17.9) | 12.33 | 23.8 |
| Ethylenediaminetetra-acetic acid | 292 | $1.0 \times 10^{-21}$ | (21) | 0.58 | 28.6 |

TABLE 2

| Example | Compound | Application quantity (mmole/m$^2$) |
|---|---|---|
| 1 A | Na acrylate | 10.9 |
| 1 B | Na acrylate | 18.1 |
| 2 A | Na vinyl sulphonate | 6.5 |
| 2 B | Na vinyl sulphonate | 13 |
| 3 A | Na acetate | 10.9 |
| 3 B | Na acetate | 18.1 |
| 4 A | 4-OH benzoic acid Na salt | 6.4 |
| 4 B | 4-OH benzoic acid Na salt | 10.6 |
| 5 A | Na thiosulphate pentahydrate | 8.23 |
| 5 B | Na thiosulphate pentahydrate | 10.7 |
| 6 | Li thiocyanate | 4.9 |
| 7 | Na citrate dihydrate | 3.5 |
| 8 A | Trisodium trithiocyanurate nonahydrate | 2.5 |
| 8 B | Trisodium trithiocyanurate nonahydrate | 4.2 |
| 9 A | Trisodium methylenediaminetetraacetate hydrate | 2.85 |
| 9 B | Trisodium methylenediaminetetraacetate hydrate | 4.7 |
| 10 A | Diammoniummethylenediaminetetra-acetate hydrate | 3.5 |
| 10 B | Diammoniummethylenediaminetetra-acetate hydrate | 5.8 |

EXAMPLES 11 TO 15

The coating was applied as in examples 1 to 10 with the difference that the solution according to the invention was not applied onto the dye-fixing layer but underneath the dye-fixing layer. The application quantities of the substances used amounted to, in the dry state (Table 3):

TABLE 3

| Example | Compound | Application quantity (mmole/m$^2$) |
|---|---|---|
| 11 | Na acrylate | 6.0 |
| 12 | Na vinyl sulphonate | 2.7 |
| 13 A | Na acetate | 1.7 |
| 13 B | Na acetate | 3.4 |
| 14 A | Na thiosulphate pentahydrate | 3.3 |
| 14 B | Na thiosulphate pentahydrate | 4.4 |
| 15 | Disodium fumarate | 1.75 |

Comparison Examples

Comparison Example VI

An ink-jet paper consisting of a polyethylene-coated paper, an ink-absorbing and a dye-fixing layer was used. The paper and the layers are composed in the same way as in Examples 1 to 15. This recording material does not contain the compounds used according to the invention.

Comparison Example V2

A conventional standard paper for ink-jet printers from Epson Inc. was used for reference purposes.

Comparison Example V3

A conventional standard paper for ink-jet printers from Canon Inc. was used for reference purposes.

Comparison Example V4 and V5

The tests were carried out as in examples 1 to 10 with the difference that, in the aqueous coating solution, N vinyl acetamide (V4) and ethylenediaminetetraacetic acid (V5) was used for the upper layer. The N-vinyl acetamide contains a double bond but no charge centres. Ethylenediaminetetraacetic acid has a dissociation constant of $1 \times 10^{-21}$.

The application quantities of the substances used amounted to, in the dry state (Table 4):

TABLE 4

| Example | Compound | Application quantity (mmole/m$^2$) |
|---|---|---|
| V1 | FS in-house standard | No additives |
| V2 | OEM standard Epson PM | No additives |
| V3 | OEM standard Canon Pr101 | No additives |
| V4 A | N-vinyl acetamide | 10.9 |
| V4 B | N-vinyl acetamide | 18.1 |
| V5 A | Ethylenediaminetetraacetic acid | 3.1 |
| V5 B | Ethylenediaminetetraacetic acid | 5.2 |

Test

The recording materials obtained were tested for their resistance to ozone, color density, gloss, coalescence and bleed.

The basis for the tests consisted of color prints from two different printer types: Epson Stylus 870 Photo Printer and Canon S800 Photo Printer. Circular dots with a diameter of 10 mm were printed for the colors cyan, magenta, yellow and black. The test results are summarised in Tables 5 to 9.

Resistance to ozone—The printed paper samples were dried and stored for 24 hours while the effect of light, gas and moisture was excluded. Subsequently, the calorimetric L*a*b values of the colored surfaces were determined.

In the next step, the samples were stored for 24 hours in an ozone chamber at an ozone concentration of 3.5 ppm, a temperature of 20 to 22° C. and a relative atmospheric humidity of 40 to 50%. Subsequently, the L*a*b* values were measured again and the degree of fading ΔE was determined.

The L*a*b* values were measured by means of an X-Rite Color Digital Swatchbook (X-Rite Inc., Grandville, Mich., USA). The calculation of the difference in tint ΔE was effected in line with the equation:

$$\Delta E=[(\Delta L^*)^2+[\Delta a^*)^2+(\Delta b^*)^2]^{1/2}.$$

Fading of any colored surface in comparison with the standard material is calculated as % ΔE in line with the following equation (DIN 6174) and listed in Tables 5 to 9: % ΔE=(ΔE/ΔE standard)×100%. The lower the % ΔE value, the better the resistance of the material to ozone.

Color density—The color density was measured with an X-Rite Densitometer, type 428, using the colors cyan, magenta, yellow and black. The higher the value for a certain color, the better the color density.

Gloss—The gloss was measured with a gloss meter made by Dr. Lange GmbH according to DIN 67530 at an angle of 60°. The measurement was carried out on an unprinted recording sheet.

Bleed—The running into each other of the inks at the edges of colored surfaces lying together was assessed visually by awarding marks 1 (very good) to 5 (very poor).

Coalescence—The disturbance or color coalescence with a colored surface arises as a result of the merging of ink droplets not yet taken up by the recipient layer to form a larger liquid phase. After drying, the colored surface is characterized by an uneven color distribution or so-called 'color disturbance'. It is assessed visually by awarding the marks 1 (very good) to 5 (very poor).

TABLE 5

Print and gloss properties (Epson 870 Printer) (Embodiment I).

| | Example | Gloss % 60° | Coalescence | Bleed | Color density Cyan/Magenta/Yellow/Black |
|---|---|---|---|---|---|
| V1 | FS in-house standard | 40 | O | O | 2.38; 1.79; 1.05; 2.41 |
| V2 | OEM Standard Epson PM | 35 | O | O | 2.46; 1.84; 1.08; 2.55 |
| V4 A | N-vinyl acetamide | 39 | O | O | 2.31; 1.78; 1.04; 2.31 |
| V4 B | N-vinyl acetamide | 38.9 | O | | 2.35; 1.75; 1.04; 2.32 |
| V5 A | Ethylenediaminetetra-acetic acid | 43.1 | O | O | 2.38; 1.73; 1.09; 2.34 |
| V5 B | Ethylenediaminetetra-acetic acid | 43.3 | O | O | 2.16; 1.62; 1.08; 2.26 |
| 1 A | Na acrylate | 43.1 | O | O | 1.97; 1.68; 1.09; 2.27 |
| 1 B | Na acrylate | 38.2 | O | O | 1.92; 1.68; 1.11; 2.25 |
| 2 A | Na vinyl sulphonate | 40.3 | O | O | 2.09; 1.73; 1.09; 2.34 |
| 2 B | Na vinyl sulphonate | 40.9 | O | O | 2.09; 1.72; 1.10; 2.31 |
| 3 A | Na acetate | 41.6 | O | O | 2.21; 1.81; 1.08; 2.38 |
| 3 B | Na acetate | 43.1 | O | O | 2.12; 1.76; 1.12; 2.38 |
| 4 A | 4-OH benzoic acid Na salt | 46.8 | O | O | 2.22; 1.82; 1.13; 2.54 |
| 4 B | 4-OH benzoic acid Na salt | 47.5 | O | O | 2.32; 1.83; 1.13; 2.48 |
| 5 A | Na thiosulphate pentahydrate | 39.8 | O | O | 2.01; 1.76; 1.06; 2.30 |
| 5 B | Na thiosulphate pentahydrate | 42.2 | O | O | 2.02; 1.73; 1.11; 2.31 |
| 6 | Li thiocyanate | 46.3 | O | O | 2.34; 1.88; 1.13; 2.44 |
| 7 | Na citrate dihydrate | 42.2 | O | O | 2.14; 1.75; 1.13; 2.32 |
| 8 A | Trisodiumtrithiocya-nurate nonahydrate | 43.7 | O | O | 2.20; 1.80; 1.12; 2.36 |
| 8 B | Trisodiumtrithiocya-nurate nonahydrate | 44.6 | O | O | 2.20; 1.79; 1.14; 2.33 |
| 9 A | Trisodium methylenediaminetetra-acetate hydrate | 44.3 | OX | OX | 2.12; 1.61; 1.12; 2.41 |
| 9 B | Trisodium methylenediaminetetra-acetate hydrate | 47.1 | OX | OX | 2.11; 1.52; 1.13; 2.38 |
| 10 A | Diammonium ethylenediaminetetra-acetate hydrate | 44.3 | O | O | 2.08; 1.61; 1.12; 2.33 |

TABLE 5-continued

Print and gloss properties (Epson 870 Printer) (Embodiment I).

| | Example | Gloss % 60° | Coalescence | Bleed | Color density Cyan/Magenta/ Yellow/Black |
|---|---|---|---|---|---|
| 10 B | Diammonium ethylenediaminetetra-acetate hydrate | 47.1 | OX | OX | 2.07; 1.44; 1.13; 2.32 |

O - no coalescence or bleed between the color blocks red/green (200%)

OX - slight coalescence or bleed

TABLE 6

Printing and gloss properties (Canon S800 Printer) (Embodiment I)

| | Example | Gloss % 60° | Coalescence | Bleed | Color density cyan/magenta/ yellow/black |
|---|---|---|---|---|---|
| V1 | FS in-house standard | 40 | O | O | 2.57; 1.88; 1.10; 2.34 |
| RV | OEM Standard Canon PR101 | 52 | O | O | 2.41; 1.83; 1.11; 2.22 |
| V4 A | N-vinyl acetamide | 38.5 | O | O | 2.36; 1.74; 1.07; 2.03 |
| V4 B | N-vinyl acetamide | 38.1 | O | O | 2.32; 1.75; 1.06; 1.97 |
| V5 A | Ethylenediaminetetra-acetic acid | 43.1 | O | O | 2.46; 1.82; 1.13; 2.09 |
| V5 B | Ethylenediaminetetra-acetic acid | 43.3 | O | O | 1.98; 1.76; 1.15; 2.01 |
| 1 A | Na acrylate | 43.7 | O | O | 2.19; 1.73; 1.11; 1.79 |
| 1 B | Na acrylate | 38.2 | O | O | 2.14; 1.74; 1.11; 1.68 |
| 2 A | Na vinyl sulphonate | 40.3 | O | O | 2.19; 1.72; 1.10; 1.72 |
| 2 B | Na vinyl sulphonate | 40.9 | O | O | 2.20; 1.74; 1.12; 1.75 |
| 3 A | Na acetate | 41.6 | O | O | 2.09; 1.64; 1.14; 1.83 |
| 3 B | Na acetate | 43.1 | O | O | 2.10; 1.67; 1.17; 1.79 |
| 5 A | Na thiosulphate pentahydrate | 39.8 | O | O | 2.15; 1.70; 1.14; 1.85 |
| 5 B | Na thiosulphate pentahydrate | 42.2 | O | O | 2.13; 1.69; 1.12; 1.83 |
| 6 | Li thiocyanate | | O | O | 2.38; 1.76; 1.11; 2.30 |
| 7 | Na citrate dihydrate | 42.2 | O | O | 2.19; 1.74; 1.15; 1.94 |
| 8 A | Trisodiumtrithiocyanu-rate nonahydrate | 43.7 | O | O | 2.25; 1.65; 1.14; 1.90 |
| 8 B | Trisodiumtrithiocyanu-rate nonahydrate | 44.6 | O | O | 2.28; 1.69; 1.14; 1.92 |
| 9 A | Trisodiummethylenedia-minetetraacetate hydrate | 44.3 | O | O | 2.34; 1.80; 1.11; 1.96 |
| 9 B | Trisodiummethylenedia-minetetraacetate hydrate | 47.1 | OX | OX | 2.22; 1.84; 1.12; 1.85 |
| 10 A | Diammoniumethylenedia-minetetraacetate hydrate | 44.3 | OX | OX | 2.36; 1.81; 1.13; 1.91 |
| 10 B | Diammoniumethylenedia-minetetraacetate hydrate | 47.1 | OX | OX | 2.24; 1.84; 1.14; 1.82 |

TABLE 7

| Resistance to ozone (Embodiment I) | | | | |
|---|---|---|---|---|
| | Epson 870 | | Canon S 800 | |
| Example | % ΔE total | % ΔE cyan | % ΔE total | % ΔE cyan |
| V1 | 100 | 100 | 100 | 100 |
| V2Epson | 71 | 61 | — | — |
| V3Canon | — | — | 110 | 105 |
| V4 | 100 | 100 | 96 | 92 |
| V5 | 105 | 101 | 107 | 100 |
| 1 A | 17 | 3 | 14 | 18 |
| 1 B | 8 | 2 | 8 | 10.5 |
| 2 A | 60 | 59 | 60 | 65 |
| 2 B | 52 | 52 | 45 | 48 |
| 3 A | 40 | 31 | 77 | 18 |
| 3 B | 30 | 26 | 14 | 10.5 |
| 4 A | 67 | 63.9 | — | — |
| 4 B | 55 | 48.5 | — | — |
| 5 A | 33 | 41 | 35 | 37 |
| 5 B | 6 | 2 | 10 | 10 |
| 6 | 27.5 | 39 | 15 | 17 |
| 7 | 72 | 66 | 77 | 75 |
| 8 A | 70 | 54 | 50 | 67 |
| 8 B | 62 | 7 | 24 | 20 |
| 9 A | 71 | 51 | 67 | 71 |
| 9 B | 24 | 18 | 22 | 33 |
| 10 A | 72 | 70 | 77 | 62 |
| 10 B | 25 | 18 | 28.5 | 22 |

TABLE 8

| Print and gloss properties (Epson 870 printer) Embodiment II) | | | | | |
|---|---|---|---|---|---|
| | Example | Gloss % 60° | Coalescence | Bleed | Color density cyan/magenta/ yellow/black |
| R1 | FS in-house standard | 45.5 | O | O | 1.98; 1.35; 1.07; 2.41 |
| 11 | Na acrylate | 39 | O | O | 1.61; 1.17; 1.03; 1.83 |
| 12 | Na vinyl sulphonate | 37.5 | O | O | 1.61; 1.17; 1.03; 1.83 |
| 13A | Na acetate | 38.2 | O | O | 2.16; 1.73; 1.08; 2.23 |
| 13B | Na acetate | 35.3 | O | O | 2.10; 1.67; 1.07; 2.22 |
| 14A | Na thiosulphate pentahydrate | 19 | O | O | 1.92; 1.62; 1.05; 2.01 |
| 14B | Na thiosulphate pentahydrate | 22.5 | O | O | 1.87; 1.59; 1.05; 1.96 |
| 15 | Disodium fumarate | 30.3 | O | O | 1.65; 1.18; 1.07; 1.85 |

TABLE 9

| Resistance to ozone (Embodiment II) (Epson 870 Printer). | | |
|---|---|---|
| | % E | |
| Example | % ΔE total | % ΔE cyan |
| R1 | 100 | 100 |
| 11 | 43 | 51 |
| 12 | 80 | 81 |
| 13A | 69 | 75 |
| 13B | 58 | 60 |
| 14A | 57 | 53 |

TABLE 9-continued

| Resistance to ozone (Embodiment II) (Epson 870 Printer). | | |
|---|---|---|
| | % E | |
| Example | % ΔE total | % ΔE cyan |
| 14B | 53 | 62 |
| 15 | 59 | 68 |

As seen in Tables 7 and 9, a noticeable improvement in the resistance to ozone can be achieved by means of the compounds used according to the invention.

We claim:

1. Ink-jet recording material comprising at least one ink-absorbing and at least one dye-fixing layer wherein on the top and/or bottom side of the dye-fixing layer, at least one water-soluble compound exhibiting ionic charge centres is arranged, which compound exhibits a dissociation constant in the region of $1\times10^{-3}$ to $1\times10^{-14}$ with a conductivity range λ of 6 to 25 ms at a temperature of 25° C.±1° C. in a 0.1 molar aqueous solution.

2. Recording material according to claim 1 wherein the water-soluble compound is contained in a pigment-free layer on the top and/or bottom side of the dye-fixing layer.

3. Recording material according to claim 1 wherein the compound contains functional groups from the group of $RCO_2^-$, $RO^-$, $RS^-$, $SCN^-$, $S_2O_3^-$ and/or $RSO_3^-$, R being a substituted or unsubstituted alkyl with 1 to 8 carbon atoms or a substituted or unsubstituted, aromatic or non-aromatic ring system with 5 to 10 carbon atoms.

4. Recording material according to claim 1 wherein the water-soluble compound contains at least one double bond in the molecule.

5. Recording material according to claim 3 wherein the water-soluble compound contains at least one double bond in the molecule.

6. Recording material according to one of claim 1 wherein the water-soluble compound has a solubility in water of more than about 10% by wt. at 25° C.

7. Recording material according to claim 2 wherein the pigment-free layer contains a water-soluble and/or water-dispersible polymer which has a glass transition temperature $T_g$ of 30 to 85° C. (DSC) and a viscosity of maximum 60 cPs, measured in a 4% aqueous solution.

8. Recording material according to claim 2 wherein the weight ratio of polymer/compound is in the range of 1:1 to 1:10.

9. Recording material according to claim 2 wherein the application weight of the pigment-free layer is $\leqq 5$ g/m$^2$, in particular 0.05 to 2 g/m$^2$.

10. Recording material according to claim 1 wherein the compound exhibiting ionic charge centres is selected from alkali acrylate salt, alkali vinyl sulphonate, alkali acetate salt, alkali thiosulphate pentahydrate, alkali thiocyanate, alkali citrate hydrate, trialkali trithiocyanurate nonahydrate, trialkali ethylenediaminetetraacetate hydrate, diammonium ethylenediaminetetraacetate hydrate, dialkali fumarate, dialkali malonate and the ammonium salts of the above-mentioned alkali compounds.

11. Recording material according to claim 3 wherein the compound contains functional groups from the group of $RCO_2^-$, $RO^-$, $RS^-$, $SCN^-$, $S_2O_3^-$ and/or $RSO_3^-$, R being a substituted or unsubstituted alkyl with 1 to 4 carbon atoms or a substituted or unsubstituted, aromatic or non-aromatic ring system with 5 to 10 carbon atoms.

* * * * *